US011098553B2

(12) United States Patent
Benzie et al.

(10) Patent No.: US 11,098,553 B2
(45) Date of Patent: Aug. 24, 2021

(54) METHOD FOR SEALING A REGION OF OPEN HOLE GRAVEL PACK

(71) Applicant: Mohawk Energy LTD., Houston, TX (US)

(72) Inventors: Scott A. Benzie, Houston, TX (US); Alessandro Caccialuppi, Houston, TX (US)

(73) Assignee: Mohawk Energy Ltd., Houston, TX (US)

( * ) Notice: Subject to any disclaimer, the term of this patent is extended or adjusted under 35 U.S.C. 154(b) by 64 days.

(21) Appl. No.: 16/543,081

(22) Filed: Aug. 16, 2019

(65) Prior Publication Data

US 2020/0056444 A1 Feb. 20, 2020

Related U.S. Application Data

(60) Provisional application No. 62/719,808, filed on Aug. 20, 2018.

(51) Int. Cl.
*E21B 33/12* (2006.01)
*E21B 43/08* (2006.01)

(52) U.S. Cl.
CPC ..... *E21B 33/12* (2013.01); *E21B 33/1204* (2013.01); *E21B 43/08* (2013.01)

(58) Field of Classification Search
CPC ..... E21B 33/1204; E21B 43/08; E21B 33/12; E21B 43/103; E21B 43/105; E21B 43/106; E21B 43/108
See application file for complete search history.

(56) References Cited

U.S. PATENT DOCUMENTS 7,603,758 B2 * 10/2009 Cook ..... A47B 43/00 166/242.6
2015/0211328 A1 * 7/2015 Lowry ..... E21B 33/1208 166/300
2016/0032696 A1 * 2/2016 Caccialupi ..... E21B 29/10 166/384
2019/0186230 A1 * 6/2019 Carragher ..... E21B 33/134
2020/0332620 A1 * 10/2020 Carragher ..... E21B 36/003

* cited by examiner

*Primary Examiner* — Michael R Wills, III
(74) *Attorney, Agent, or Firm* — Tumey L.L.P.

(57) ABSTRACT

A system for sealing a region of open hole gravel pack comprising a sealing patch and an installation tool is described. The sealing patch includes a tubular assembly including two expandable anchor/seals and two low melting temperature alloy elements positioned on outside surface of the tubular assembly above the anchor/seals. The system is deployed in desirable location in the well and the tool is operated to set anchor/seals in interference contact with sand-screen. Then the alloy elements are melted to seal the patch. The anchor/seals serve two purposes: they provide a hanging capacity to support the patch in the well and create a "bridge" preventing the molten alloy from freely flowing through the annulus between the tubular assembly and sand screen and focusing the molten alloy at the anchor/seals to flow in radial direction penetrating through the sand-screen and the surrounding proppant sand creating a complete seal.

7 Claims, 3 Drawing Sheets

METHOD FOR SEALING A REGION OF OPEN HOLE GRAVEL PACK

CROSS-REFERENCE TO RELATED APPLICATIONS

This application claims the benefit of U.S. Provisional Application No. 62719808 filed on Aug. 20, 2018, the entire contents of which is incorporated herein by reference thereto.

BACKGROUND OF THE INVENTION

Field of the Invention

The present invention relates to method and apparatus for sealing selected regions in open hole gravel packs in oil and gas wells.

Background of the Invention

Open hole completions and in particular Open Hole Gravel Packs (OHGP) may provide an effective way of oil or gas production from several different production zones. OHGPs comprise sand-screens within the annulus between the sand-screen and an open hole packed with the proppant/sand which allows flow of the oil or gas both through the annulus and sand-screen. However, over time, the production quality of particular zones diminishes due to a reduction in the percentage of desirable product and may result in overflow of water.

In such cases the remedial action needs to be taken to isolate a particular zone, so the wellbore can produce from the rest of the zones. Currently employed systems for isolation of particular zones utilize Low Melting Temperature (LMT) alloys such as eutectic/bismuth-based alloys mounted on the exterior wall of a tubular and a heat source inserted inside the tubular. Once in desired position in the well a heat source is used to melt the alloy, which flows some distance before it cools and solidifies. However, the melted alloy may flow in the annulus between the tubular and the sand-screen and solidify in "lumps" without penetration and sealing the proppant sand between the sand-screen and open hole. The use of expandable tubular to reduce the clearance between the MLT alloy and the sand-screen may break the MLT alloy which may fall off the tubular in the wellbore before it heated and may not produce an anchoring force for the tubular or a seal. Thus, what is needed and provided by the present disclosure is a reliable system for zonal isolation of selective regions of open hole gravel pack and a simple reliable tool setting system capable of reliably anchoring the isolation patch and focusing flow of LMT alloy through the sand-screen and proppant sand to provide an isolating seal.

BRIEF SUMMARY OF SOME OF THE INVENTION

The present invention provides a method and apparatus for sealing selective regions in Open Hole Gravel Packs (OHGP) that may be deployable and operational on a wireline. The apparatus comprises a system of a sealing patch, an expansion tool and a heater. The sealing patch comprises tubulars with two anchor/seals, and two low melting temperature alloy elements positioned around outer surface of the tubulars above the anchor/seals. The expansion tool may include two expansion devises and a thruster capable of providing a force necessary for expansion of the anchor/seals in interference contact with the sand-screen. The heater may be a chemical or an electrical source heater provided that it generates temperatures above the melting temperature of the low melting temperature alloy. The low melting temperature (LMT) alloy is defined as having a melting point of 385° C. or below, for example a eutectic/bismuth alloy.

The method for sealing a region of OHGP includes the following steps: a) deploying of the sealing patch comprising tubulars with two anchor/seals and two LMT alloy elements and the expansion tool in the desired location in the well; b) operating the expansion tool to radially expand the anchor/seals in interference contact with the sand-screen; c) heating the LMT elements so that they melt and flow through the sand-screen and proppant sand in radial direction; and allowing LMT alloys to cool and form the seals.

The anchor/seals serve two purposes. First, they provide a hanging capacity to support the tubulars in the well. Second, they provide a "bridge" preventing the molten alloy from freely flowing through the annulus between the tubulars and sand screen which leads to the creation of multiple drips/lumps of alloy on the screen rather than a complete seal. Thus, the anchor/seals by preventing free flow along the screen and focusing the molten alloy at the anchor/seals allow the molten alloy to penetrate through the sand-screen and the surrounding proppant creating a complete seal.

Also, it is appreciated that the use of the tubular patch with two seals provides zonal isolation of an interval of any desirable length which can be matched by the length of the tubular between the seals.

BRIEF DESCRIPTION OF THE DRAWINGS

These drawings illustrate certain aspects of some examples of the present disclosure, and should not be used to limit or define the disclosure.

DETAILED DESCRIPTION OF THE INVENTION

Figure 1:
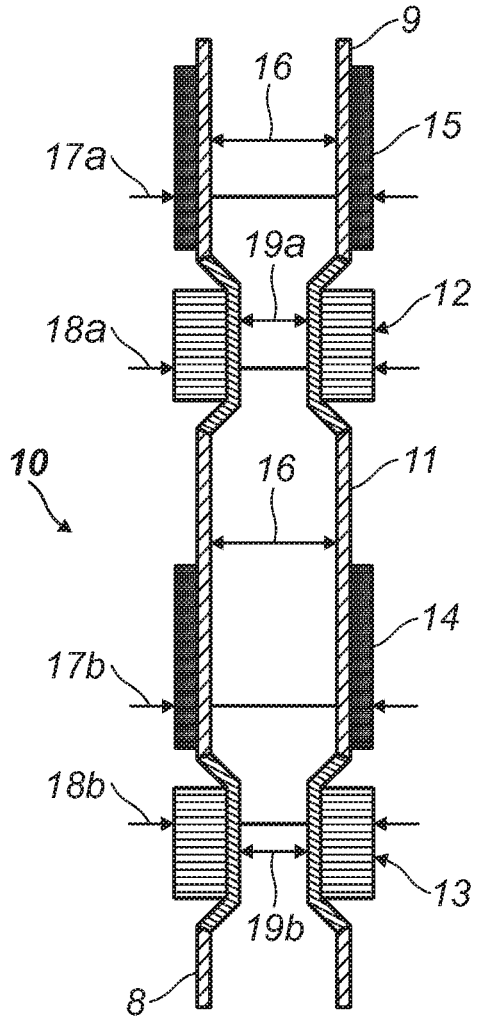
FIG. 1 shows, in cross section, a sand-screen patch of the present invention.

FIG. 1 shows a preferred embodiment of the sand-screen patch 10 of the present invention. The sand-screen patch 10 comprises a first tubular 9 attached to an anchor/seal 12, a second tubular 11 connected between anchor/seal 12 and a second anchor/seal 13, and optionally a third tubular 8 connected to a lower portion of anchor/seal 13. Two Low Melting Temperature (LMT) alloy elements 14 and 15 are positioned around the outer surfaces the tubular 11 and 9 respectively above the anchor/sealing elements. The terms "above" or "below" are referred to the directions to the top of the well or towards the bottom of the well correspondingly.

Figure 2:
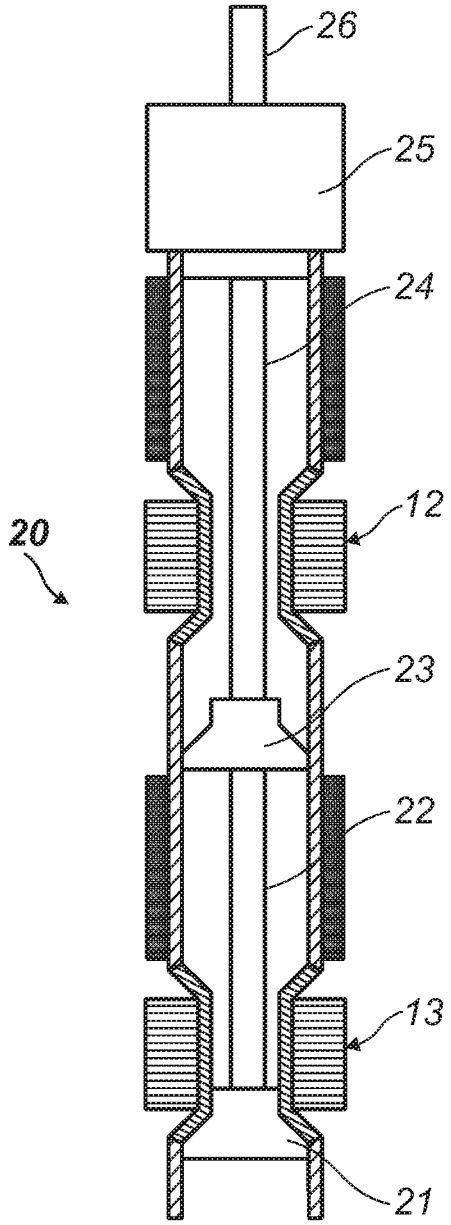
FIG. 2 shows a system for sealing a region of open hole comprising the patch shown in FIG. 1 with an expansion tool with a thruster.
Figure 3:
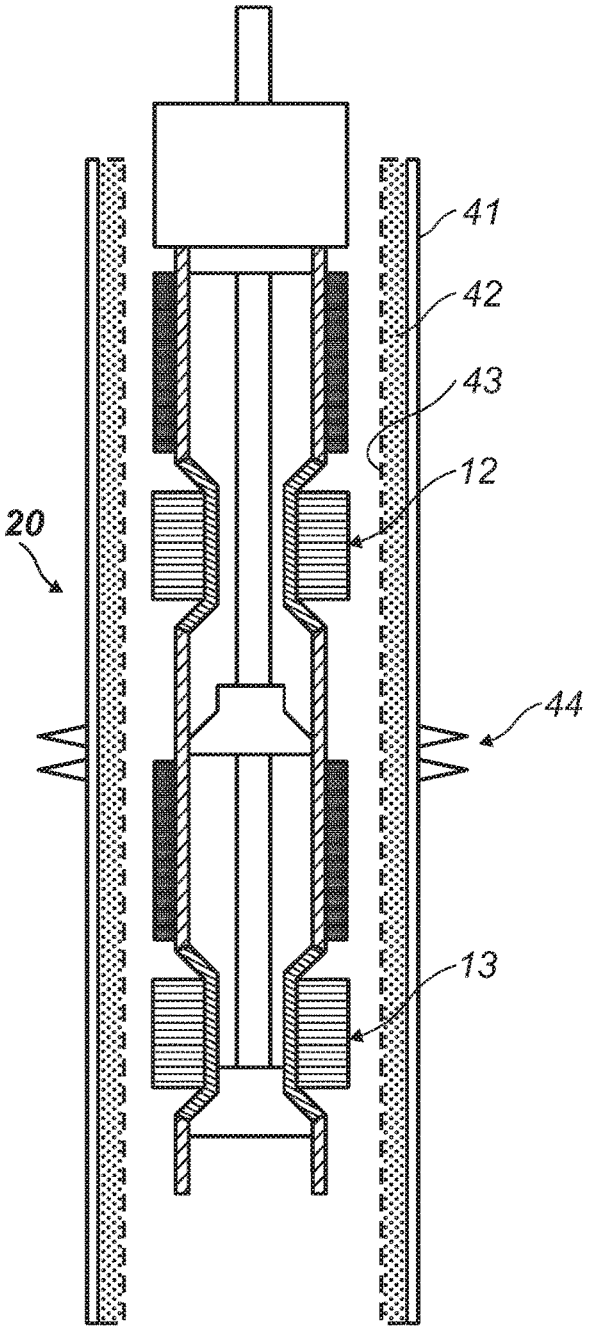
FIG. 3 shows the system shown in FIG. 2 being deployed in a well-bore.

FIG. 2 shows an exemplary system 20 for sealing a region of OHGP comprising the patch 10 with the expansion tool comprising the thruster 25, two expansion devices 21 and 23, and conduit 26. The thruster 25 may be a hydraulically operated device or an explosive device providing that it may generate force necessary for expansion of the anchor/seals 12 and 13. The expansion devices 21 and 23 such as expansion swages or cones have diameters approximately equal to the inside diameter 16 of the tubulars, see FIG. 1. The outside diameters 18*a* and 18*b* of the anchor/seals are approximately equal to the outside diameters 17*a* and 17*b* of the LMT elements. The inside diameters 19*a* and 19*b* of the anchor/seals are less than inside diameter 16 of the tubulars 9,11,8 and selected such that upon expansion by expansion devices 21 and 23 the anchor/seals 12 and 13 coming in interference contact with the sand-screen 43, see FIG. 5.

The expansion devises are connected by the shaft 22 and by the shaft 24 to the thruster. Preferably, the swages are positioned such that after expansion of the first anchor/seal 13 by swage 21 the expansion device 23 engages the second anchor/seal 12 and then expands it. This results in sequential expansion of the anchor/seals reducing necessary expansion force and minimizing the length of thruster stroke, which allows setting the patch in one stroke without resetting the thruster. This allows deployment and setting patch in the well-bore using a wireline with a pressure pump (e.g. an electric pump). Tubular 11 is not expanded by the expansion devices 21, 23 above and below the anchor/seals 12, 13.

Figure 4:
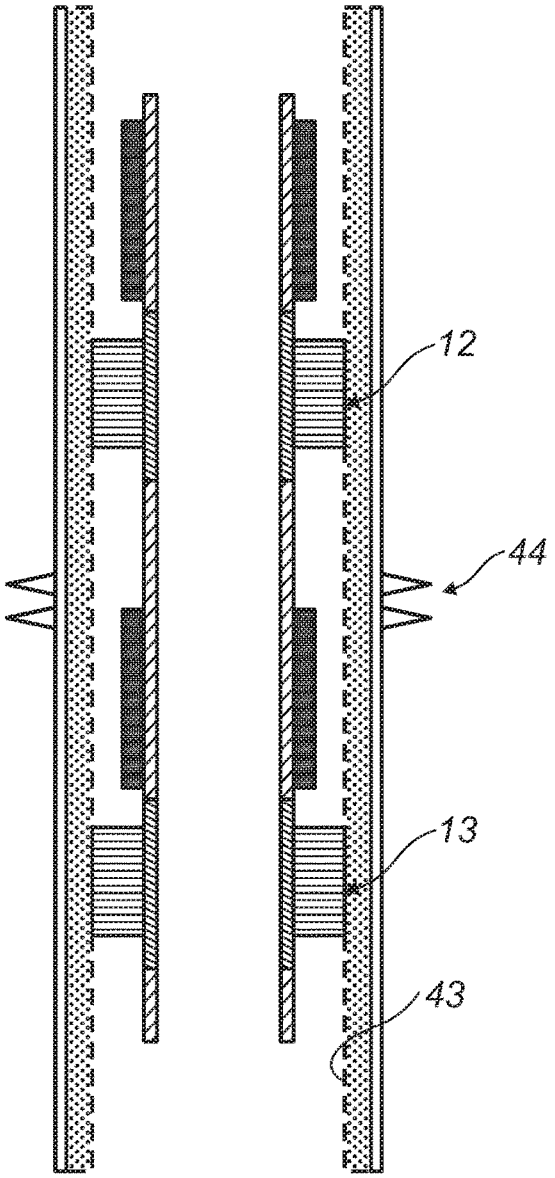
FIG. 4 shows the sand-screen patch shown in FIG. 1 after expansion in the well-bore.

In operation, the system 20 for sealing a region of OHGP may be deployed in the well-bore comprising the bore-hole formation 41, the sand screen 43 and the proppant/sand 42 between formation 41 and sand-screen 43, see FIG. 4. The patch is positioned such that the upper anchor/seal 12 is above the region 44 desired to be sealed-off and the bottom anchor/seal 13 is below the region 44. Then the expansion device is actuated expanding both anchor/seals in interference contact with the sand screen 43 and expansion device is removed from the well, FIG. 5.

Figure 5:
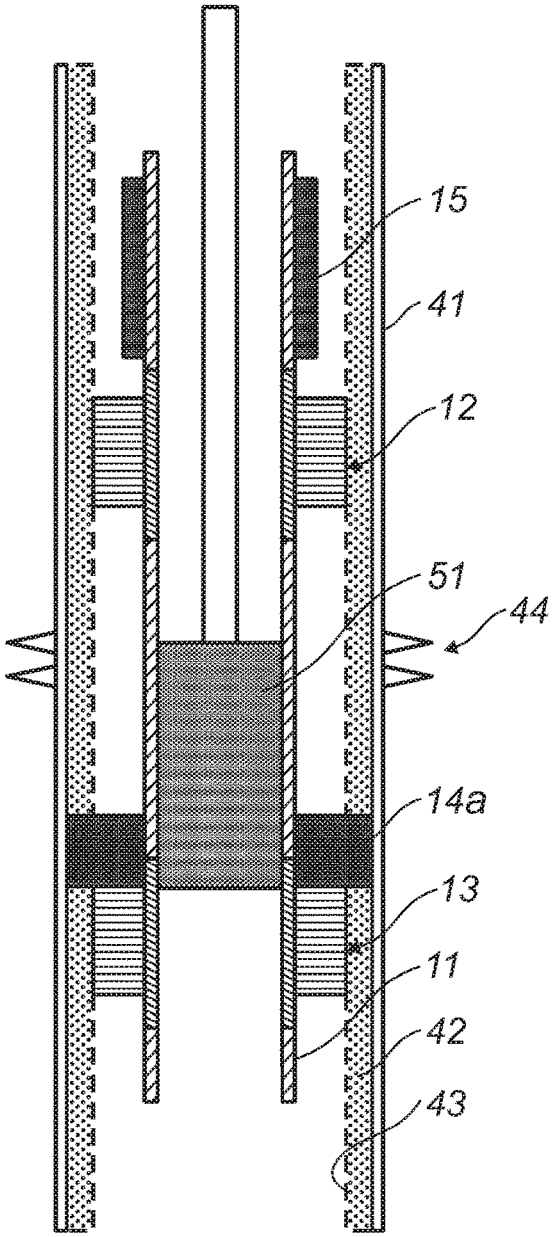
FIG. 5 shows the sand-screen patch with the bottom seal set using a heater.
Figure 6:
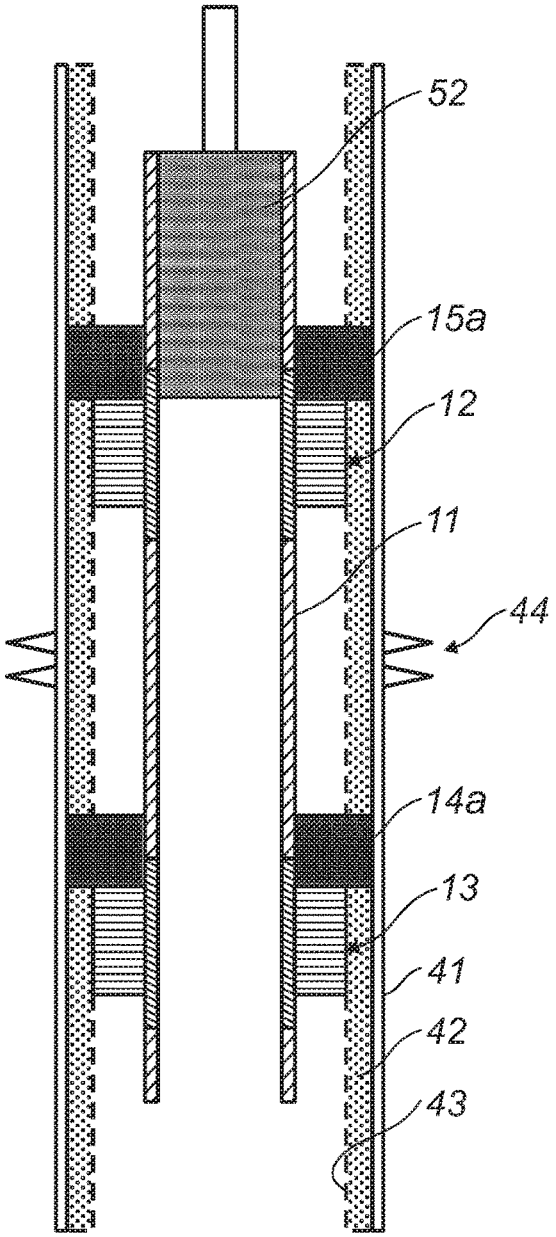
FIG. 6 shows the sand-screen patch with the upper seal set using a heater.

FIG. 5 shows the heater 51 being deployed in the well-bore and positioned at the location of the LMT alloy element above the anchor/seal 13. Then the heater is activated melting the LMT alloy. The expanded anchor/seal 13 prevents flow of the molten alloy through the annulus below anchor/seal so that molten alloy penetrates the sand screen 43 and the proppant 42 outward all the way to the formation 41 creating a complete seal 14*a* at the anchor/seal 13. Then the same or another heater 52, depending on the nature of the heater, is positioned at the LMT alloy element above the anchor/seal 12, see FIG. 6. The heater is activated melting the LMT alloy. As described above, because of the blocking of flow of the molten alloy down the well-bore through the annulus between the tubulars and the sand-screen 43, the molten alloy penetrates the sand screen 43 and the proppant 42 outward all the way to the formation 41 creating a complete seal 15*a* at the anchor/seal 12. Finally, the heater is removed from the well-bore. As a result, the LMT alloy seals 14*a* and 15*a* and the tubular assembly provide a complete isolation of the region 44 preventing inflow of undesirable liquids or gases into the well-bore. Alternatively, the heat source may be positioned at the outer surface of the tubulars 9,11,8 or inside the tubulars 9,11,8 above or below the expansion devises before deployment of the sealing patch in the well.

It will be appreciated that the tubulars 9, 11, may be of any necessary length to suit the spacing of the producing and non-producing zones. It is also envisaged that the sand-screen patch may have one, two or more anchor/seals and LMT alloy components. It is also envisaged that the tubular 11 may be an expandable tubular, being expanded while setting anchor/sealing elements. The term "anchor/seal" as used herein may refer to a sealing device, an anchoring device, or to a combination of a sealing and anchoring device.

What is claimed is:

1. A system for sealing a region of open hole gravel pack comprising a well sand-screen, comprising:

a tubular assembly comprising first and second tubulars and a first anchor/seal and a second anchor/seal coupled to the tubular assembly, wherein internal diameters of the first and the second anchor/seals are less than an internal diameter of the tubulars;

a first low melting temperature alloy element positioned around an outer surface of the tubular assembly above the first anchor/seal and a second low melting temperature alloy element positioned around an outer surface of the tubular assembly above the second anchor/seal;

an expansion tool comprising:

a first expansion device, and a second expansion device coupled to a shaft, wherein the second expansion device is positioned between the first and second anchor/seals, and a thruster coupled to the shaft and capable of providing a force necessary for expansion of the first and second anchor/seals in interference contact with the well sand-screen; and a heater capable of melting the low melting temperature alloy elements.

2. The system of claim 1, wherein a distance between the first and the second expansion devices is selected such that upon expansion of the first anchor/seal by the first expansion device, the second expansion device approximately engages the second anchor/seal.

3. The system of claim 2, further comprising a wireline with a pressure pump.

4. A method for sealing a region of open hole gravel pack comprising a well sand-screen, comprising: deploying a system for sealing the region of open hole gravel pack comprising: a tubular assembly comprising first and second tubulars, and a first anchor/seal and a second anchor/seal coupled to the tubular assembly, wherein an internal diameter of the first and the second anchor/seals are less than an internal diameter of the tubulars, a first low melting temperature alloy element positioned around an outer surface of the tubular assembly above the first anchor/seal and a second low melting temperature alloy element positioned around an outer surface of the tubular assembly above the second anchor/seal; an expansion tool comprising: a first expansion device, and a second expansion device coupled to a shaft, wherein the second expansion device is positioned inside the tubular assembly between the first and second anchor/seals, a thruster coupled to the shaft and capable of providing a force necessary for expansion of the first and second anchor/seals in interference contact with the well sand-screen; positioning the tubular assembly in a well such that the first anchor/seal is below and the second anchor/seal is above a region desired to be sealed; operating the expansion tool to expand the anchor/seals in interference contact with the well sand screen; heating the first and second low melting temperature alloys so that they melt and flow through the well sand-screen and proppant sand in a radial direction; and allowing the alloys to cool and solidify and form seals.

5. The method of claim 4, wherein the expansion devices do not expand any of the tubulars.

6. The method of claim 4, wherein a distance between the first and the second expansion devices is selected such that upon expansion of the first anchor/seal by the first expansion device, the second expansion device approximately engages the second anchor/seal.

7. The system of claim 4, further comprising a wireline with a pressure pump.

* * * * *